United States Patent [19]

Bena

[11] 4,265,961

[45] May 5, 1981

[54] BUILDING DEVICE

[75] Inventor: Gilbert A. Bena, Paris, France

[73] Assignee: Barbara S.A., Paris, France

[21] Appl. No.: 672,843

[22] Filed: Apr. 2, 1976

[30] Foreign Application Priority Data

Apr. 11, 1975 [FR] France ..... 75 11338

[51] Int. Cl.[3] ..... B32B 7/00

[52] U.S. Cl. ..... 428/253; 52/309.17; 156/148; 156/149; 156/247; 264/228; 427/176; 428/254

[58] Field of Search ..... 428/253, 254, 255, 257, 428/259; 156/148, 149, 247; 52/309.13, 309.16, 309.17, 743, 63; 264/228, 229; 427/171, 176

[56] References Cited

U.S. PATENT DOCUMENTS

| | | | |
|---|---|---|---|
| 2,823,156 | 2/1958 | Hedges | 428/253 |
| 3,127,306 | 3/1964 | Tarton et al. | 428/253 |
| 3,256,130 | 6/1966 | Nisbet et al. | 428/254 |
| 3,411,181 | 11/1968 | Cawley | 264/229 |
| 3,440,133 | 4/1969 | Burnett | 428/253 |
| 3,457,136 | 7/1969 | Zaadnoordyk | 264/136 |
| 3,547,162 | 12/1970 | Schaerer | 156/149 |
| 3,668,051 | 6/1972 | Seemans . | |
| 3,682,201 | 8/1972 | Atwell et al. | 156/149 |
| 3,723,234 | 3/1973 | MacDonald | 428/253 |
| 3,762,977 | 10/1973 | Langfeldt | 428/253 |
| 3,782,063 | 1/1974 | Batorewicz et al. | 52/63 |
| 4,065,339 | 12/1977 | Luppert et al. | 427/176 |

FOREIGN PATENT DOCUMENTS

| | | | |
|---|---|---|---|
| 8802 | of 1891 | United Kingdom | 428/253 |

*Primary Examiner*—James J. Bell

[57] ABSTRACT

The invention relates to building.

The invention relates to a building device characterised in that it comprises a layer of at least one knitted fabric elastically deformable in all directions on an at least temporarily supporting skeleton, and a binder capable of setting on the knitted fabric.

4 Claims, 3 Drawing Figures

BUILDING DEVICE

Figure 1:
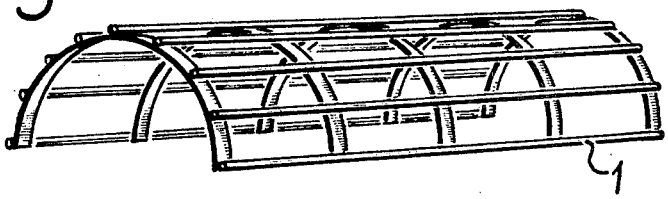

The invention relates to building.

It has already been proposed to use complex building materials wherein reinforcements are covered by binders which set, e.g. in the case of reinforced concrete or plaster.

In these methods of building, it is usually necessary to use formwork on which the reinforcements are deposited after which the binder is poured on in liquid form, the formwork being removed only after the binder has set.

It has also been proposed to form reinforced coatings, inter alia on walls, by securing a sort of trellis to the wall and applying a binder capable of setting over the whole.

The formwork technique is complicated because, even if the formwork can be reused, it requires skilled workmen and takes a relatively long time to assemble.

Conventional trellises are difficult to use, since they can be deformed to only a limited, inaccurate extent. The main object of the invention is to obviate these disadvantages, both with regard to prices and with regard to ease of use.

To this end, the invention relates to a building device characterised in that it comprises, on a supporting skeleton, a layer of at least one knitted fabric which can be resiliently deformed in all directions and which receives a binder capable of setting. Although the fabric on a skeleton can be used in conventional manner in formwork by pouring the binder over the entire skeleton, its most advantageous application is where the binder is applied by spraying, since the elasticity of the stitches facilitates the penetration of the sprayed binder through the apertures and the formation of a continuous layer of binder which at least partially embeds the fabric, since the stitches shrink after spraying, before the binder has completely set.

Of course, this elasticity makes it easier to cover the skeleton in the required manner, even if its shape is complex. The same result would be difficult to achieve in the case of a non-stretchable trellis, even if deformable.

The stitches in the knitted fabric may vary depending on its application and the substances used for covering it. The sizing of the material forming the stitches depends on the expected strength, in view of the fact that when the fabric has been embedded it can no longer be elastically deformed. If the materials are textiles or similar, monofilaments or spun, they can be chosen from a wide range, depending on the stresses and the physical and chemical compatibilities of the media to which they have to be exposed.

The stitch structure can vary isotropically or otherwise, depending on the required deformability.

Preferably, the structure is such that the knitted fabric cannot be unravelled, since this facilitates use.

Preferably, the fabric is based on multiple substances having complementary effects, such as spun polyamides and elastomer threads.

The following description of a non-limitative example of a knitted texture and of an embodment, with reference to the accompanyng drawings, will clearly show how the invention can be put into practice.

Figure 2:
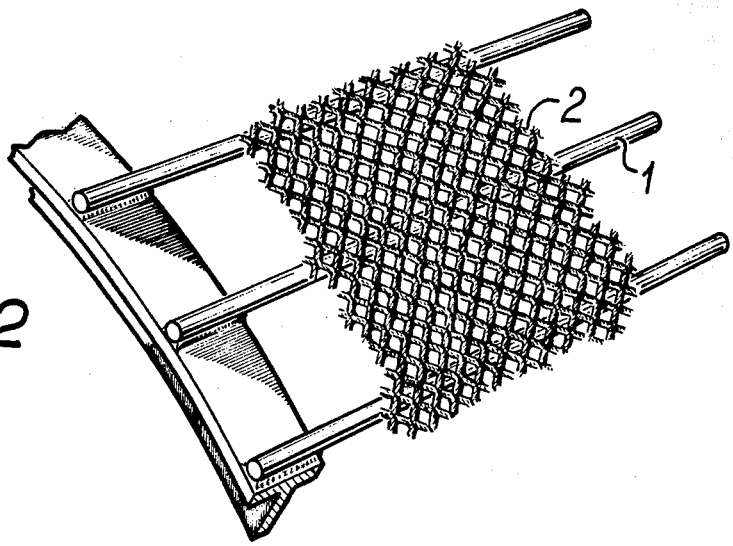
Figure 3:
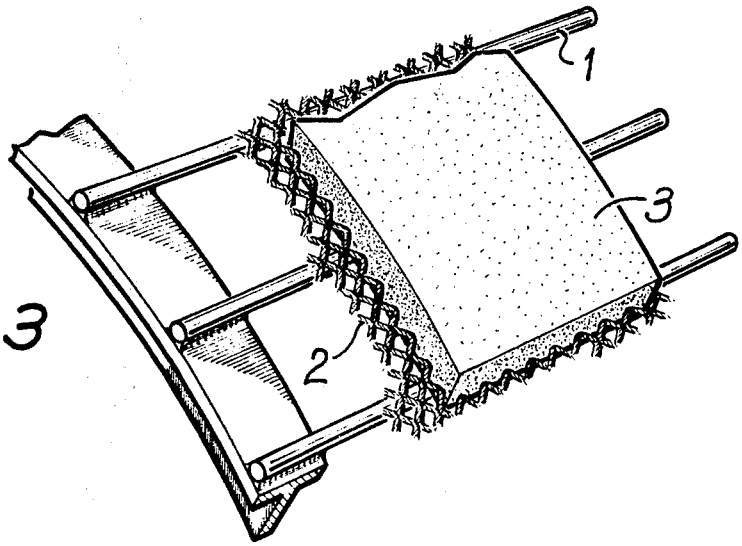

FIG. 1 is a diagrammatic perspective view of a reinforcing skeleton of a hollow body, FIG. 2 is a partial, larger-scale view of a detail showing how an elastically stretchable knitted fabric is secured to the skeleton, and FIG. 3, corresponding to FIG. 2, shows an area of knitted fabric partly covered with a binder.

In the building device under consideration, the knitted fabric cannot be unravelled and is elastically stretchable in all directions. It is constructed inter alia on a RASCHEL SUPER GARANT loom with four bars, 36 English gauge, using the following materials:

| | |
|---|---|
| Bar 1, Bar 2 | Polyamide, 150-denier (167 Decitex) |
| Bar 3, Bar 4 | Elastomer, 840-denier (940 Decitex) |

| Bar 1 | | Bar 2 | | Bar 3 | Bar 4 |
|---|---|---|---|---|---|
| 6 | 4 | 4 | 6 | 2 | 0 |
| 4/8 | 6/2 | 6/2 | 4/8 | 2/0 | 0/2 |
| 10/6 | 0/4 | 0/4 | 10/6 | 0 | 2 |
| 4/8 | 6/2 | 6/2 | 4/8 | | |
| 10/6 | 0/4 | 0/4 | 10/6 | | |
| 4/8 | 6/4 | 6/2 | 4/6 | | |
| 10/6 | 6/6 | 0/4 | 4/4 | | |
| 4/8 | 4/4 | 6/2 | 6/6 | | |
| 10/6 | 6/6 | θ/4 | 4/4 | | |
| 4/4 | 4/4 | 6/6 | 6/6 | | |
| 6/6 | 6 | 4/4 | 4 | | |
| 4/4 | | 6/6 | | | |
| 6/6 | | 4/4 | | | |
| 4/4 | | 6/6 | | | |
| 6/6 | | 4/4 | | | |
| 4/2 | | 6/8 | | | |
| 0/4 | | 10/6 | | | |
| 6/2 | | 4/8 | | | |
| 0 | | 10 | | | |

Threading is as follows:

| | |
|---|---|
| Bar 1, Bar 2, Bar 3, Bar 4 | Threading 1 on 4 |

As FIG. 1 shows, a skeleton 1 made up of assembled bars is provided for forming a structure or structural element. A knitted fabric 2 of the kind previously defined is deposited on skeleton 1 and subjected to uniform tension in all directions by securing it to some of the bars or junctions between them. As a result, the size of the stitches remains substantially constant all over the fabric.

It can be secured by any suitable conventional means. The shape of the knitted fabric can very easily be adapted to the most complex shapes of skeletons, whether convex or concave.

A layer 3 of pasty binder or liquid of sufficient viscosity can be applied, preferably by spraying, to fabric 2 as shown in FIG. 3. Owing to the propulsive force resulting from spraying or the coating pressure, for example, the stitches of fabric 2 temporarily open to allow a determined amount of coating material to travel behind the fabric. Next, the stitches close and tend even if the amount of coating applied is small, to form a continuous layer of coating, capable of serving as a backing for subsequent coats. Subsequently, the components surrounding the stitches are embedded to a relatively great depth, so that the coating can reach and, if required, even cover the components of skeleton 1, after the knitted fabric. The skeleton can also be adapted to remain in position in the building element, or can be removable for re-use.

Of course, when the coating has hardened, the knitted fabric becomes rigid and loses all its flexibility and elasticity.

Of course, without departing from the invention, modifications can be made to the embodiments described, and the applications of the invention extend to all branches of building. For example, the invention can be applied to different branches, e.g. furnishing, bodies and hulls and artistic or other plastic objects such as dummies and busts, all coming under the general concept expressed by the term "building". The structure of the skeletons can be varied (e.g. they can be assemblies of rods or bars of any shape) and there is also a choice of binders.

What is claimed is:

1. A method of forming a rigid shaped building element comprising the steps of providing at least one layer of a runproof knitted textile fabric having substantially uniform stretch characteristics in all directions, placing said layer of fabric on a frame to form said fabric into a desired predetermined shape and tensioned in at least one direction, maintaining said fabric on said frame under tension, applying a liquid coating capable of setting into a hard material to at least one surface of said fabric sufficient to fill the interstices of said knitwork and the loops thereof and to extend therethrough, thereafter permitting said coating to harden while maintaining said fabric under tension to thereby fix said fabric in said predetermined shape and tension and thereafter removing said tensioned hardened fabric from said form to provide a self-sustainable rigid non-deformable element.

2. The method according to claim 1, wherein said fabric is tensioned in one direction only on said framework.

3. The method according to claim 1, wherein said liquid coating is applied by spraying under pressure.

4. A shaped rigid non-deformable building element made in accordance with the method of claim 1 or 2 or 3.

* * * * *